US009120620B2

(12) United States Patent
Warren et al.

(10) Patent No.: US 9,120,620 B2
(45) Date of Patent: Sep. 1, 2015

(54) FLEXIBLE BULK CONTAINER AND DETACHABLE SUPPORT STRUCTURE THEREFOR

(75) Inventors: Robert P. Warren, Kitchener (CA); Michael G. Sirois, Ottawa (CA); Roderick D. Muir, South Mountain (CA); Philip Streets, Ottawa (CA)

(73) Assignee: BETTER BAGS INTERNATIONAL CORP., Komoka (CA)

( * ) Notice: Subject to any disclaimer, the term of this patent is extended or adjusted under 35 U.S.C. 154(b) by 582 days.

(21) Appl. No.: 13/379,825

(22) PCT Filed: Jun. 22, 2010

(86) PCT No.: PCT/CA2010/000963

§ 371 (c)(1),
(2), (4) Date: Dec. 21, 2011

(87) PCT Pub. No.: WO2010/148497

PCT Pub. Date: Dec. 29, 2010

(65) Prior Publication Data

US 2012/0103981 A1 May 3, 2012

(30) Foreign Application Priority Data

Jun. 22, 2009 (CA) ..... 2669995

(51) Int. Cl.

| | |
|---|---|
| ***B65F 1/14*** | (2006.01) |
| *B65D 6/18* | (2006.01) |
| *B65B 67/12* | (2006.01) |

(52) U.S. Cl.

CPC ..... *B65F 1/1415* (2013.01); *B65B 67/1205* (2013.01); *B65D 11/186* (2013.01); *B65F 2240/118* (2013.01)

(58) Field of Classification Search

CPC ..... B65D 11/186; B65D 7/30; B65D 21/086; B65D 2543/00194; B65D 90/205; B65B 67/12; B65B 67/1205; B65B 67/1233; B65F 1/0006; B65F 1/1415; B65F 2220/106; B65F 2240/118; E04H 15/001; E04H 15/40; E04H 15/42; E04H 15/44; E04H 15/48; E04H 2004/146; E04H 4/0056

USPC ..... 220/4.08, 4.16, 4.28–4.29, 4.33, 6, 666, 220/668, 7, 9.1–9.4; 229/117.01–117.03; 248/95, 99–101; 211/189, 198, 211/200–201; 135/87, 121, 156

See application file for complete search history.

(56) References Cited

U.S. PATENT DOCUMENTS 2,941,710 A 6/1960 Smith et al.
3,762,343 A * 10/1973 Thacker ..... 206/512

(Continued)

FOREIGN PATENT DOCUMENTS

| | | | |
|---|---|---|---|
| CA | 2139560 | A1 | 7/1996 |
| CA | 2367855 | A1 | 10/2000 |
| CA | 2634884 | A1 | 12/2008 |

OTHER PUBLICATIONS

Written Opinion of the International Searching Authority issued Sep. 21, 2010 in respect of corresponding International Application No. PCT/CA2010/000963.

*Primary Examiner* — Mickey Yu
*Assistant Examiner* — Brijesh V. Patel
(74) *Attorney, Agent, or Firm* — Bereskin & Parr LLP/S.E.N.C.R.L., s.r.l.

(57) ABSTRACT

A flexible bulk container includes side walls coupled to a bottom wall. The side walls and the bottom wall generally enclose an interior space that is accessible through a top of the flexible bulk container for loading materials therein. A support structure includes elongate frame elements. Each of the frame elements may be attached to at least one of the side walls and is configured to support the at least one of the side walls generally upright so that the flexible bulk container is maintained in a generally open position. Each of the frame elements may be detachable from the respective at least one of the side walls. The flexible bulk containers and the support structures may be used in a waste management system for loading and sorting of bulk waste materials.

20 Claims, 16 Drawing Sheets

(56) References Cited

U.S. PATENT DOCUMENTS

| | | | | | |
|---|---|---|---|---|---|
| 3,810,482 | A | * | 5/1974 | Beavers | 135/147 |
| 3,874,398 | A | * | 4/1975 | Hendrickson | 135/144 |
| 4,180,113 | A | * | 12/1979 | Liebling | 383/7 |
| 4,646,802 | A | * | 3/1987 | Basore et al. | 220/9.4 |
| 4,934,636 | A | * | 6/1990 | Orlosky et al. | 248/95 |
| 4,989,749 | A | * | 2/1991 | Choi | 220/9.4 |
| 5,011,103 | A | | 4/1991 | Hayes et al. | |
| 5,106,041 | A | | 4/1992 | Jelincic | |
| 5,628,338 | A | * | 5/1997 | Stumbo | 135/147 |
| 5,806,815 | A | | 9/1998 | Knutson | |
| 5,979,842 | A | | 11/1999 | Fan | |
| 6,021,796 | A | * | 2/2000 | Vavra | 135/147 |
| 6,076,782 | A | | 6/2000 | Alderman | |
| 6,276,548 | B1 | * | 8/2001 | Mitchell | 220/9.4 |
| 6,491,264 | B1 | | 12/2002 | Valesquez | |
| 6,508,443 | B1 | * | 1/2003 | Andreasson | 248/97 |
| 6,953,127 | B1 | * | 10/2005 | Esser | 220/9.3 |
| D524,900 | S | * | 7/2006 | Reis | D21/837 |
| 7,431,173 | B2 | | 10/2008 | Thorpe | |
| 2004/0118983 | A1 | * | 6/2004 | Reichert | 248/95 |
| 2005/0045639 | A1 | * | 3/2005 | Thorpe | 220/495.01 |
| 2006/0207641 | A1 | * | 9/2006 | Reis et al. | 135/87 |
| 2008/0083443 | A1 | * | 4/2008 | Eastman, II | 135/121 |
| 2008/0137997 | A1 | | 6/2008 | Perkins | |
| 2010/0154282 | A1 | * | 6/2010 | Lau | 43/1 |
| 2010/0243014 | A1 | * | 9/2010 | Shires | 135/124 |

* cited by examiner

FLEXIBLE BULK CONTAINER AND DETACHABLE SUPPORT STRUCTURE THEREFOR

CROSS REFERENCE TO RELATED APPLICATIONS

This is a national stage application of International Application No. PCT/CA2010/000963 filed on Jun. 22, 2010, which claims priority to Canadian Patent Application No. 2,669,995 filed on Jun. 22, 2009, and the entire contents of each are hereby incorporated herein by reference.

FIELD

This specification relates to flexible bulk containers.

BACKGROUND

The following paragraphs are not an admission that anything discussed in them is prior art or part of the knowledge of persons skilled in the art.

Canadian Patent No. 2,139,560 describes a method of manufacturing a bulk bag comprising fabricating a fabric side wall structure and providing a plurality of lift loops each having a first and second leg portion. The legs of each lift loop are aligned at spaced locations around the top of the side wall structure, in positions for ready penetration by the tines of a forklift truck, with both leg portions of each lift loop extending a given distance downwardly from the top edge of the side wall structure. The leg portions of each of the lift loops are stitched to the top of the side wall structure by at least three parallel lines of high-strength thread, preferably by chain stitching or lock stitching. The stitching lines are all sewn in one or at most two passes; they extend horizontally across the lift loop legs to anchor the lift loops securely to the top of the side wall structure. There is no horizontal fold of the top of the side wall structure extending down to the anchor stitching.

U.S. Pat. No. 7,431,173 describes an intermediate bulk container comprising a storage container which is made from a suitable flexible material, a forklift pallet base including pole engaging formations on its upper surface which are arranged about its periphery, a plurality of poles the lower ends of which are releasably engageable with formations on the pallet base to provide a support cage for the storage container, a holed pole location member including pole engaging formations with which the upper ends of the poles are engageable to lock the poles together to inhibit transverse outward bulging of the storage container from between the poles and to preserve the container support cage against a load in the storage container with the underside of the pallet base and the upper surface of the pole locating member including formations, which are releasably engageable with compatible formations on containers below and above it in a stack.

U.S. patent application No. 20080137997 describes a stackable collapsible container for flowable materials. The container has a flexible outer skin and rigid support, having a top frame and bottom frame connected by poles. The top frame and bottom frame are designed for mating engagement when the containers are stacked, as well as for mating engagement when the containers are broken down for transport. The top frame and bottom frame are provided with similar perimeters to prevent undesired movement and contact between adjacent top frame when the containers are filled and transported.

SUMMARY

In an aspect of this specification, a flexible bulk container comprises a plurality of side walls coupled to a bottom wall, the side walls and the bottom wall generally enclosing an interior space that is accessible through a top of the flexible bulk container. A support structure comprises a plurality of elongate frame elements, each of the frame elements attached to at least one of the side walls and configured to support the at least one of the side walls generally upright so that the flexible bulk container is maintained in a generally open position, each of the frame elements being detachable from the respective at least one of the side walls.

The frame elements may be arranged externally of the interior space of the flexible bulk container. The frame elements may be coupled to an outer surface of the side walls. Each of the frame elements may be detachable from the respective at least one of the side walls independently of the others of the frame elements. There may be at least one of the frame elements per each of the side walls. There may be two of the frame elements per each of the side walls.

The frame elements may be flexible and resilient. A first one of the frame elements may extend diagonally generally between a first lower corner of the at least one of the side walls and a first upper corner opposite from the first lower corner. A longitudinal dimension of the first one of the frame elements may be greater than a diagonal dimension between the first lower and upper corners, so that the first one of the frame elements is in a flexed condition and biases the first lower and upper corners away from one another. A second one of the frame elements may extend diagonally generally between a second lower corner of the at least one of the side walls and a second upper corner opposite from the second lower corner. A longitudinal dimension of the second one of the frame elements may be greater than a diagonal dimension between the second lower and upper corners, so that the second one of the frame elements is in a flexed condition and biases the second lower and upper corners away from one another.

The corners of the at least one of the side walls comprise corner patches which may be configured to retain ends of the first and second ones of the frame elements. The corner patches may comprise pockets sized and shaped to retain the ends of the first and second ones of the frame elements. The corner patches may be stitched to form the pockets. The ends of the first and second ones of the frame elements may comprise clips configured to grip the respective corner patch. The corners of the at least one of the side walls may comprise corner connectors, the corner connectors comprising a base portion mounted to the at least one of the side walls and a tube portion coupled to the base portion, the tube portion sized and shaped to retain ends of the first and second ones of the frame elements.

A central loop may couple the first and second ones of the frame elements together generally where the first and second ones of the frame elements diagonally overlap. The central loop may be fixed to the at least one of the side walls.

The at least one of the side walls may comprise a plurality of elongate sleeves for coupling the first and second ones of the frame elements to the at least one of the side walls.

Each of the frame elements may comprise two half segments. The at least one of the side walls may comprise a central patch configured to retain inward ends of the half segments, so that each of the half segments extends diagonally between the central patch and a different corner of the at least one of the side walls. The central patch may define four pockets sized and shaped to retain the inward ends of the half segments. The support structure may further comprise a plurality of frame connectors, the frame connectors configured to connect two of the half frame segments in series between opposite corners of the at least one of the side walls. The support structure may further comprise a central connector hub configured to retain inward ends of the half segments, so that each of the half segments extends diagonally between the central connector hub and a different corner of the at least one of the side walls. The central connector hub may be fixed to the at least one of the side walls.

The frame elements may comprise first frame elements that extend generally vertically across the at least one of the side walls. The first frame elements may be arranged generally at corners of the flexible bulk container. The at least one of the side walls may comprise pockets for retaining ends of the first frame elements. The frame elements may comprise a second frame element that extends generally horizontally across the at least one of the side walls. The second frame element may be arranged generally across a middle of the at least one of the side walls. The at least one of the side walls may comprise pockets for retaining ends of the second frame element. The second frame element may comprise first and second half segments separated by a hinge.

The flexible bulk container may further comprise at least one loop coupled to at least one of the side walls for lifting the flexible bulk container. The flexible bulk container may further comprise a lid wall coupled to at least one of the side walls to cover the interior space at the top of the flexible bulk container. The flexible bulk container may further comprise a plurality of peg flaps coupled to at least one of the side walls and the bottom wall for anchoring the flexible bulk container to the ground.

In an aspect of this specification, a kit of parts comprises: at least one flexible bulk container, the at least one flexible bulk container including a bottom wall, a plurality of generally rectangular side walls coupled to the bottom wall, the side walls and the bottom wall generally enclosing an interior space that is accessible through a top of the at least one flexible bulk container, and a plurality of pockets formed on at least one of the side walls, with at least a first and a second pocket disposed generally at opposite corners of the least one of the side walls on an outer surface thereof; and a plurality of elongate, flexible and resilient frame elements, each of the frame elements attachable to the at least one of the side walls by inserting ends of the frame element into the first and second pockets so that the frame element extends diagonally between the opposite corners, a longitudinal dimension of the frame element being greater than a diagonal dimension between the first and second pockets so that the frame element is retained in a flexed condition between the first and second pockets, whereby the plurality of frame elements are attachable to form a support structure that maintains the flexible bulk container in a generally open position.

In an aspect of this specification, a method comprises: providing a first flexible bulk container; providing a support structure; attaching the support structure to at least one side wall of the first flexible bulk container so that the first flexible bulk container is maintained in a generally open position; loading materials in an interior space of the first flexible bulk container; and detaching the support structure from the at least one side wall of the first flexible bulk container.

The method may further comprise, after the step of detaching: providing a second flexible bulk container; attaching the support structure to at least one side wall of the second flexible bulk container so that the second flexible bulk container is maintained in a generally open position; loading materials in an interior space of the second flexible bulk container; and detaching the support structure from the at least one side wall of the second flexible bulk container.

The support structure may comprise a plurality of elongate frame elements, each of the frame elements attached to at least one of the side walls. Each of the frame elements may be independently attachable to and detachable from the respective at least one of the side walls. In the step of attaching, the frame elements may be generally coupled to an outer surface of the side walls. In the step of attaching, two of the frame elements may be attached per side wall. In the step of attaching, the frame elements may be attached to extend diagonally generally between opposite corners of the respective side wall. In the step of attaching, the frame elements may be resiliently flexed to enable ends of the frame elements to be inserted into pockets provided at the opposite corners of the respective side wall.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DETAILED DESCRIPTION

Figure 1:
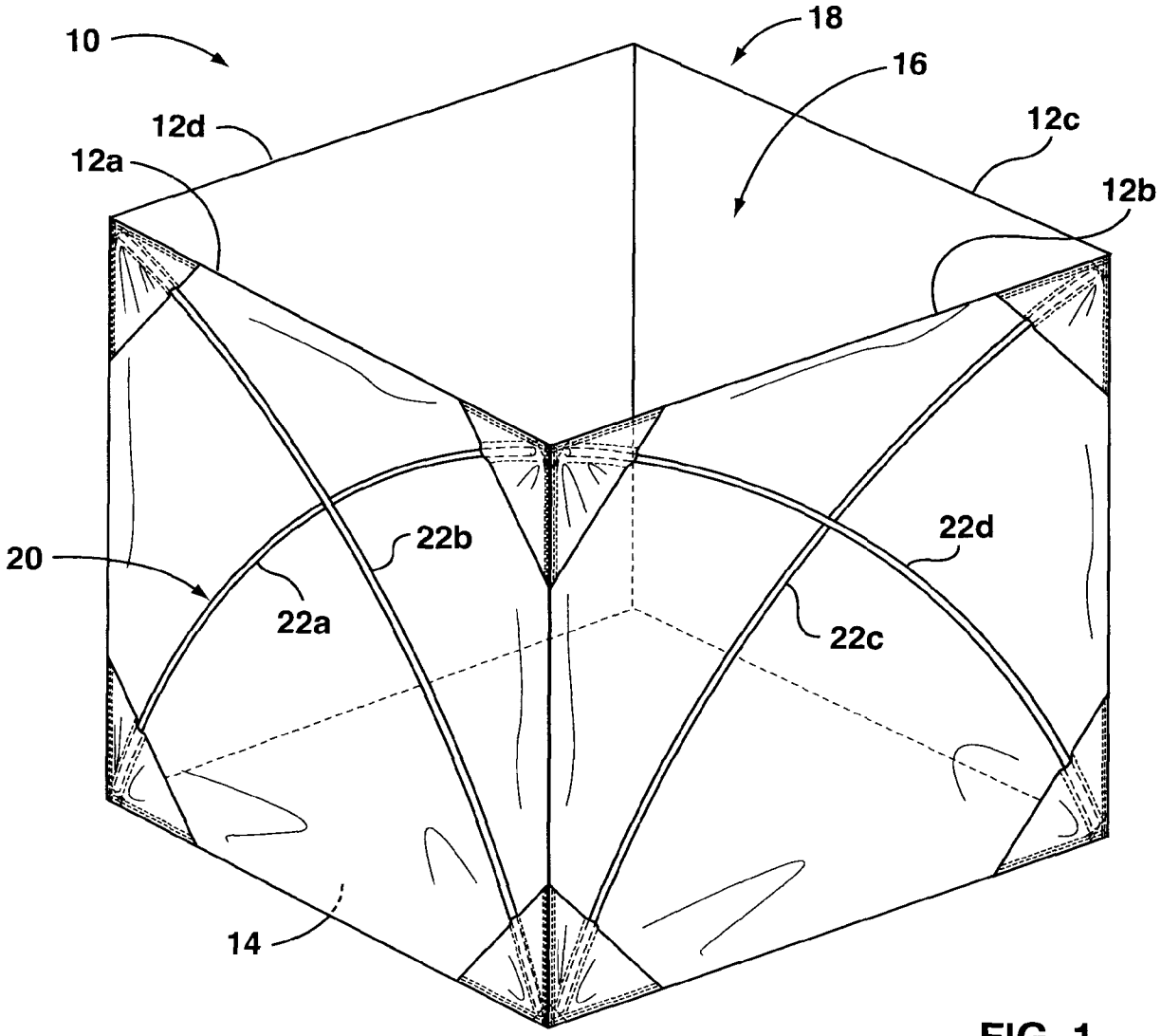
FIG. 1 is a perspective view of a flexible bulk container and a support structure therefor, according to an example.

Most waste management systems utilize roll-off dumpster containers to load and transport mixed waste materials. These methods may require transporting the containers to and from landfill or waste transfer facilities for processing. Typically, vehicles used to transport the containers are capable of carrying only one container at a time, whether it is full or empty, and furthermore each container has a fixed material volume and requires removal and replacement once full to continue operation. Transport of containers and use of equipment to sort waste material has environmental implications ranging from dust and noise pollutants to vehicle emissions.

A flexible intermediate bulk container (FIBC), which may be referred to as a bulk bag, is a standardized container for storing and transporting materials, for example but not limited to, sand, fertilizers, granules of plastics or other products. Bulk bags may be made of relatively thick woven polyethylene or polypropylene, and may measure around 110×110 cm and vary in height from 100 cm up to 200 cm. Capacity of a bulk bag may be around 1000 kg or more. Transporting and loading of bulk bags may be done using pallets or by lifting the bulk bag with loops; bulk bags may be made with either one loop or four lifting loops. Emptying may be made easy by an opening in the bottom or by simply cutting it open.

Generally, the concepts disclosed herein relate to a flexible bulk container and a support structure therefor. The support structure is configured to maintain at least portion of the side walls of the flexible bulk container generally upright, so that the flexible bulk container is presented in a generally open position to receive materials loaded into the interior space of the flexible bulk container. During or after loading of materials into the flexible bulk container, the support structure may be detached from the flexible bulk container and then used to support another flexible bulk container.

In the drawings and in this description, like reference numerals will be used to indicate like elements, functions or features as between the drawings and the described examples.

Referring to FIG. 1, a flexible bulk container is shown generally at 10. The flexible bulk container 10 includes side walls 12*a*, 12*b*, 12*c*, 12*d* which may be generally equivalent to one another in size and construction. In the example illustrated, the side walls 12*a*, 12*b*, 12*c*, 12*d* are generally rectangular.

The side walls 12*a*, 12*b*, 12*c*, 12*d* are coupled to a bottom wall 14. The side walls 12*a*, 12*b*, 12*c*, 12*d* and the bottom wall 14 generally enclose an interior space 16 that is accessible through a top 18 of the flexible bulk container 10. In the example illustrated, the interior space 16 is generally cuboidal.

The flexible bulk container 10 may be formed of various materials, including, for example but not limited to, woven polyethylene or polypropylene having a fabric weight of 7 ounces per square yard or more. Edges of the flexible bulk container 10 may be double hemmed to improve strength and tear resistance. The flexible bulk container 10 may be made in various sizes. In a particular example, the flexible bulk container 10 may have a base size of 72"×72" and a height of 60", although this particular size is not intended to be limiting and various different sizes are contemplated.

A support structure is shown generally at 20. The support structure 20 includes elongate frame elements 22*a*, 22*b*, 22*c*, 22*d*. The frame elements 22*a*, 22*b*, 22*c*, 22*d* are attached to the side walls 12*a*, 12*b* and support the side walls 12*a*, 12*b* generally upright so that the flexible bulk container 10 is maintained in a generally open position to load materials in the interior space 16. Although it is not shown in FIG. 1, the side walls 12*c*, 12*d* may also include frame elements attached thereto for supporting the side walls 12*c*, 12*d* generally upright.

The frame elements 22*a*, 22*b*, 22*c*, 22*d* may be arranged externally of the interior space 16 of the flexible bulk container 10. As illustrated, the frame elements 22*a*, 22*b*, 22*c*, 22*d* may be coupled to an outer surface of the respective side walls 12*a*, 12*b*. However, it may be appreciated that in some examples the frame elements 22*a*, 22*b*, 22*c*, 22*d* may be arranged internally of the interior space 16 of the flexible bulk container 10.

The frame elements 22*a*, 22*b*, 22*c*, 22*d* are attachable and detachable from the respective side walls 12*a*, 12*b*, and may be detached irrespective of whether the flexible bulk container 10 is empty or full of materials loaded in the interior space 16. Furthermore, each of the frame elements 22*a*, 22*b*, 22*c*, 22*d* may be detachable from the respective side walls 12*a*, 12*b* independently of one another.

It may be appreciated that the support structure 20 does not substantially extend beyond a plan view extent of the flexible bulk container 10 when viewed from above. In other words, the support structure 20 does not substantially increase the footprint of the flexible bulk container 10 when the support structure is being used to maintain the flexible bulk container 10 in a generally open position.

Figure 2:
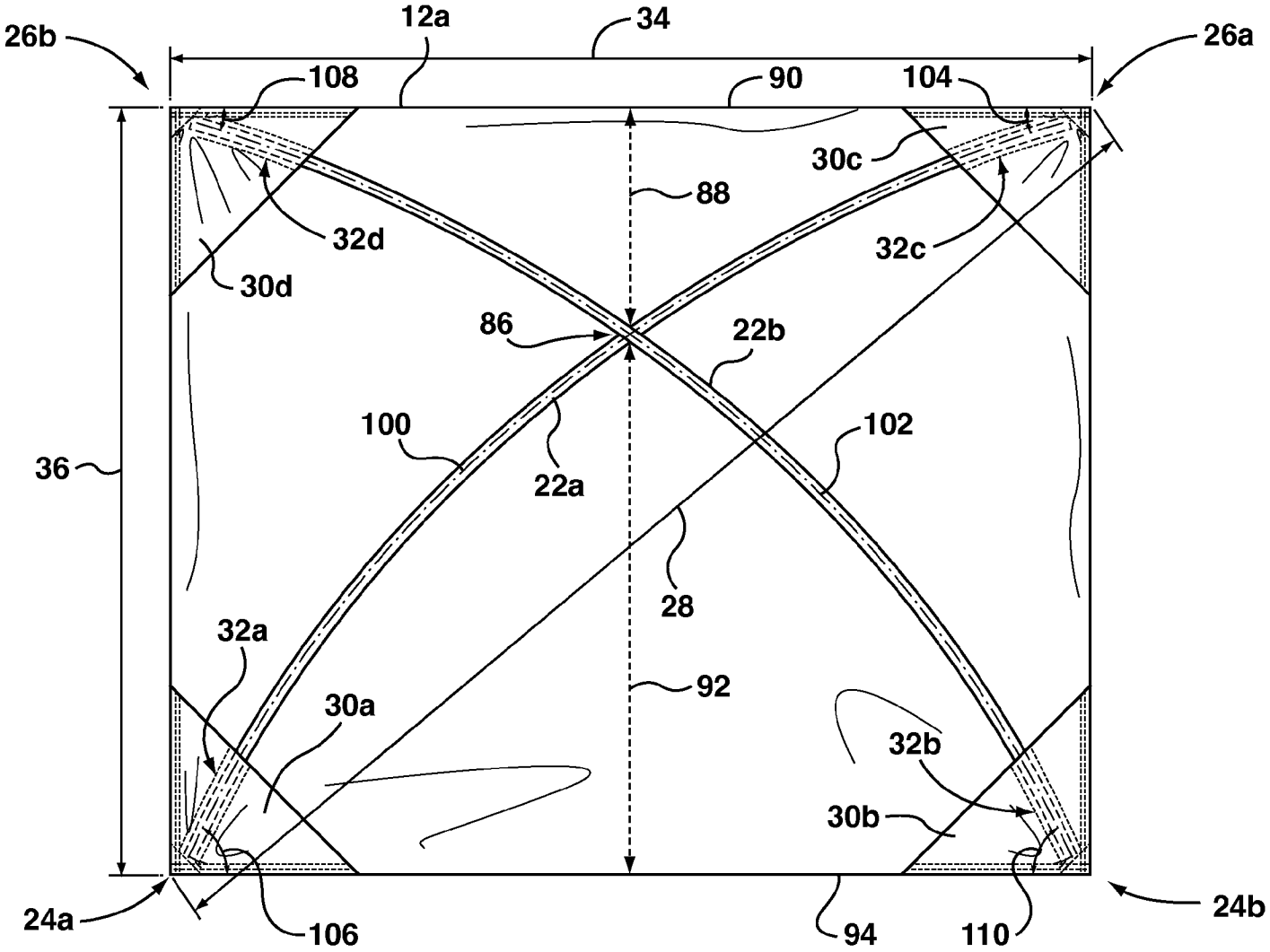
FIGS. 2, 2A and 2B are views of a side wall of the flexible bulk container and the support structure of FIG. 1.
Figure 2B:
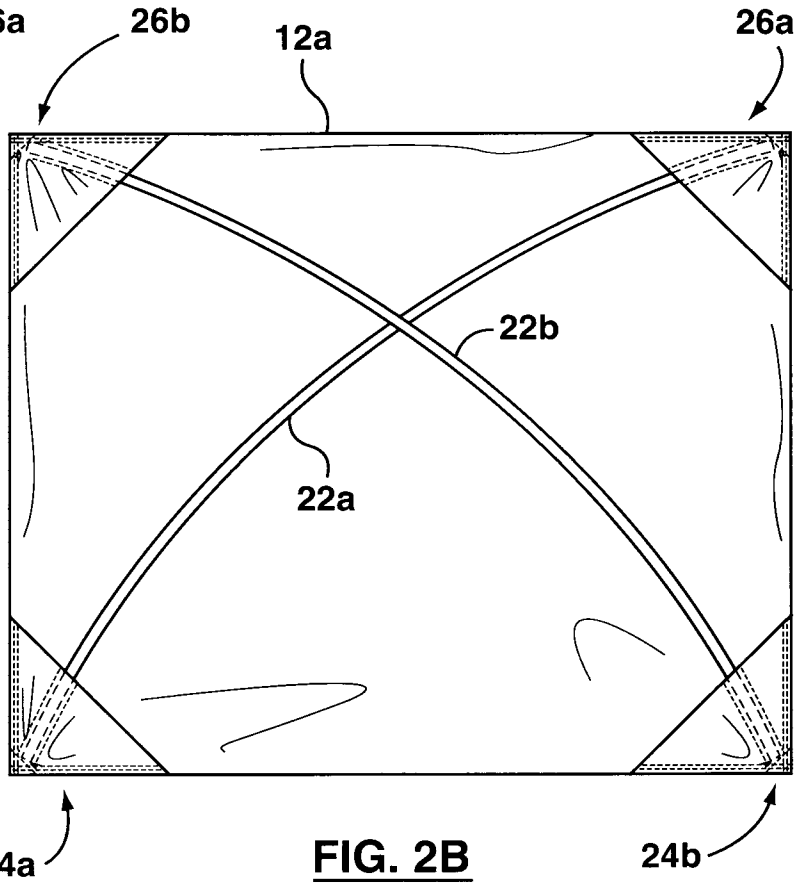
Figure 2A:
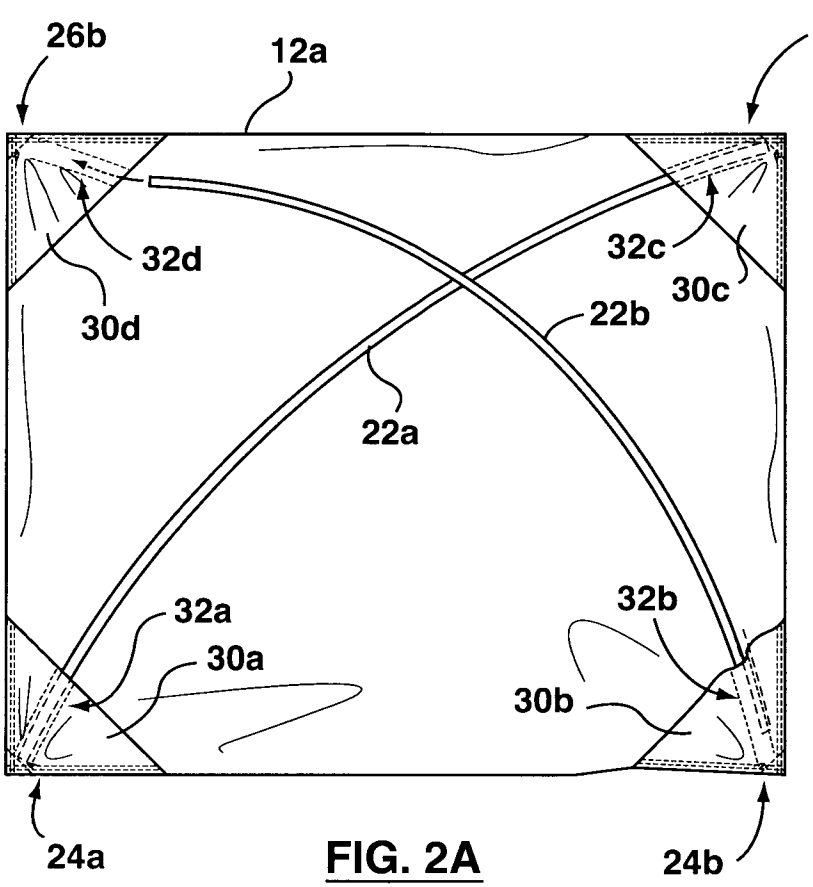

Referring to FIGS. 2, 2A and 2B, two of the frame elements 22*a*, 22*b* are shown attached to the side wall 12*a*. The frame element 22*a* extends diagonally generally between a first lower corner 24*a* and a first upper corner 26*a* of the side wall 12*a*. The corners 24*a*, 26*a* are generally opposite from one another. The frame element 22*b* extends diagonally generally between a second lower corner 24*b* and a second upper corner 26*b* of the side wall 12*a*. The corners 24*b*, 26*b* are generally opposite from one another. Thus, the frame elements 22*a*, 22*b* diagonally overlap one another at a central position 86 of side wall 12*a*. A first vertical dimension 88 between a top edge 90 of the side wall 12*a* and the central position 86 is substantially less than a second vertical dimension 92 between the central position 86 and a bottom edge 94 of the side wall 12*a*.

In the example illustrated, the corners 24*a*, 24*b*, 26*a*, 26*b* of the side wall 12*a* each include a corner patch 30*a*, 30*b*, 30*c*, 30*d*, respectively. The corner patches 30*a*, 30*b*, 30*c*, 30*d* may each define a pocket 32*a*, 32*b*, 32*c*, 32*d*, respectively, sized and shaped to retain ends of the frame elements 22*a*, 22*b*.

The frame elements 22 may be formed to be generally flexible and resilient. The inventors have determined that Xenoy™ resin may be a suitable material for forming the frame elements 22. The frame elements 22 may be tubular in construction, and a low density filler (e.g., polymer foam) may be used to fill the tubes to reduce the potential of kinking or crushing. Furthermore, in some other examples the frame elements 22 may be formed of generally rigid materials, or a combination of rigid and flexible materials. Moreover, it may be appreciated that in some examples the frame elements 22 may not each be an integral component, but may be formed from a plurality of segments that are assembled together to form the full longitudinal dimension of the frame element 22, thus reducing the size of the unassembled support structure 20.

In accordance with a particular example, each of the frame elements 22 may be formed of tubular Xenoy™ resin having a 27 mm outer diameter and a 2 mm wall section thickness, although this particular material and configuration is not intended to be limiting and various different materials and configurations are contemplated.

In some examples, referring particularly to FIG. 2, a longitudinal dimension of the frame elements 22*a*, 22*b* may be greater than a diagonal dimension 28 between the first lower and upper corners 24*a*, 26*a*. Thus, the frame elements 22*a*, 22*b* are retained in a flexed condition when attached to the side wall 12*a* and bias the lower corners 24*a*, 24*b* away from the upper corners 26*a*, 26*b*, respectively, so that the side wall 12*a* is in tension.

In a particular example, given a width dimension 34 of the side wall 12*a* of about 72" and a height dimension 36 of about 60", a longitudinal dimension of the frame elements 22*a*, 22*b* of about 91" or 92" may be suitable. However, it may be appreciated that the frame elements having a given longitudinal dimension may be operable with a range of dimensions 28, 34, 36, allowing adjustability for various sizes and volumes of the flexible bulk container 10.

In some examples, referring particularly to FIG. 2, the frame element 22*a* extends along and defines an arc axis 100 between the corners 24*a*, 26*a*, and the frame element 22*b* extends along and defines an arc axis 102 between the corners 24*b*, 26*b*. The arc axis 100 is shown to form an angle 104 with the top edge 90 and an angle 106 with the bottom edge 94, and the angle 104 is substantially smaller than the angle 106. Similarly, the arc axis 102 is shown to form an angle 108 with the top edge 90 and an angle 110 with the bottom edge 94, and the angle 108 is substantially smaller than the angle 110.

Referring particularly to FIG. 2A, to attach the frame element 22*b* to the side wall 12*a*, the frame element 22*b* is shown being resiliently flexed to enable ends of the frame element 22*b* to be inserted into the pockets 32*b*, 32*d*. FIG. 2B shows the frame elements 22*a*, 22*b* in flexed position attached to the side wall 12*a* and supporting the side wall 12*a* upright.

Figure 3:
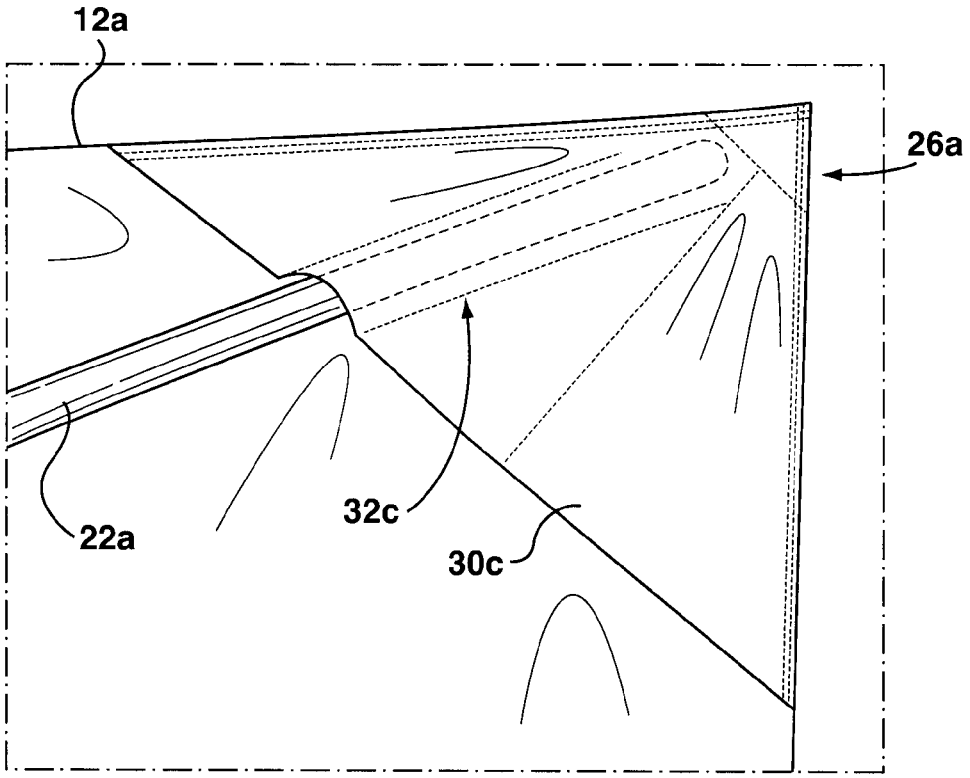
FIG. 3 is a detailed view of a corner of the flexible bulk container of FIG. 1, according to an example.

Referring to FIG. 3, the corner patch 30*c* may be stitched to the side wall 12*a*, and may be further stitched to form the pocket 32*c*, which is sized and shaped to retain the end of the frame element 22*a*. The pocket 32*c* may be suitably dimensioned so that it restricts movement of the frame element 22*a* and maintains the frame elements 22*a* generally in a defined position relative to the side wall 12*a*.

Figure 4:
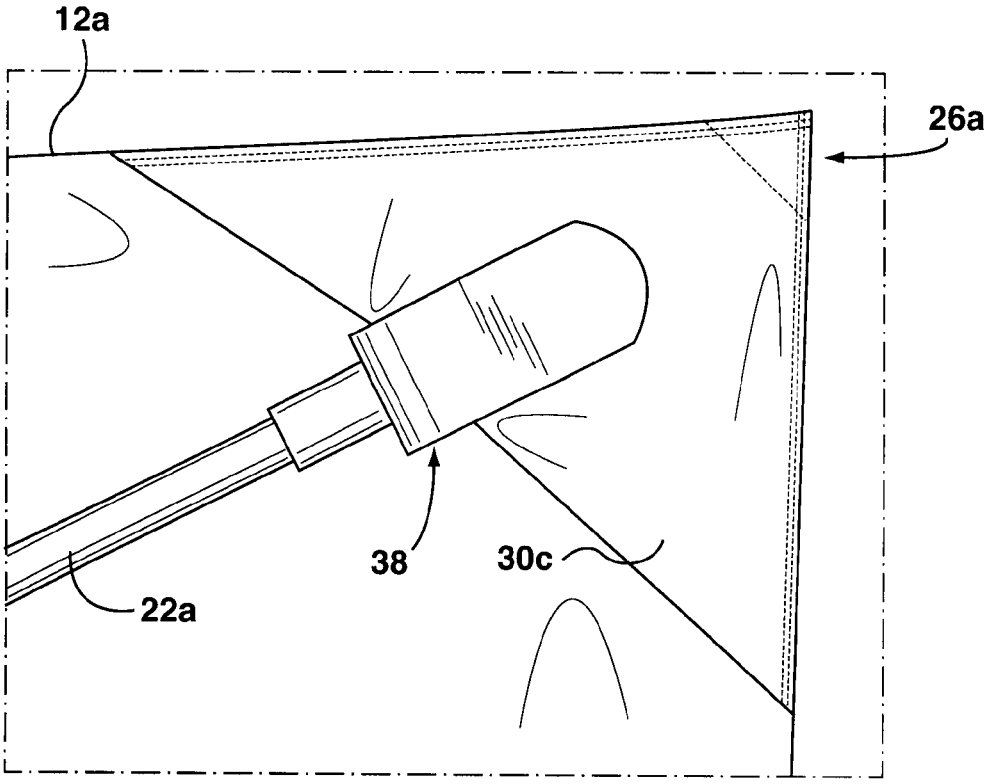
FIGS. 4 and 5 are detailed views of a corner of the flexible bulk containers according to other examples.

Referring to FIG. 4, in an alternative configuration, the end of the frame element 22*a* may include a clip 38 configured to grip an edge of the corner patch 30*c*. In some particular examples, the clip 38 may be similar to the fabric retaining clips described in U.S. Pat. No. 7,146,691. In these examples, use of such fabric retaining clips may avoid the need for the corner patches 30 since the fabric retaining clips may be used to connect directly to the corner 26*a* of the side wall 12*a*.

Figure 5:
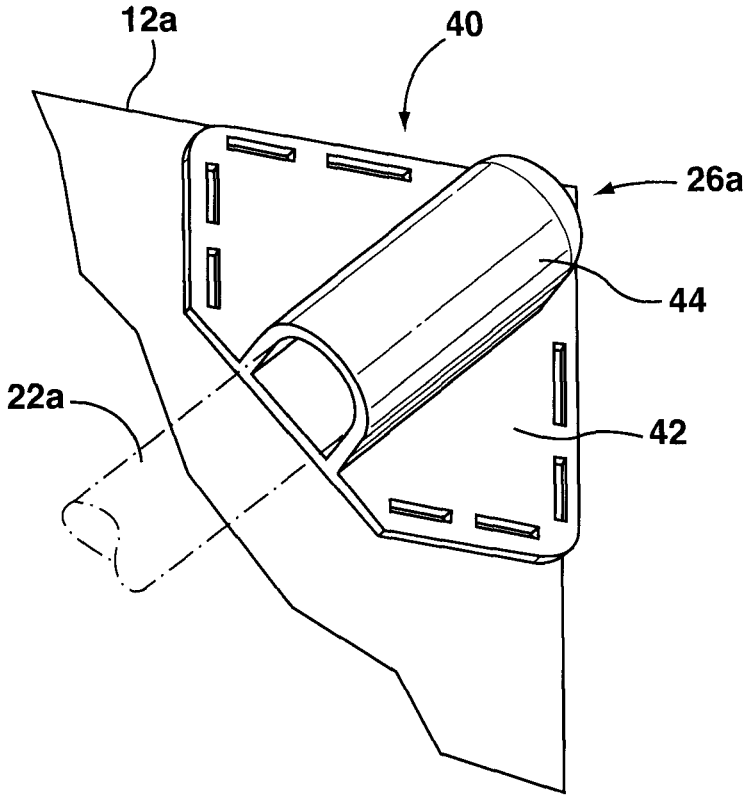

Referring to FIG. 5, in another alternative configuration, the corner 26*a* of the side wall 12*a* may include a corner connector 40 for retaining the end of the frame element 22*a*. The corner connector 40 may include a base portion 42 mounted to the side wall 12*a* at the corner 26*a*, and a tube portion 44 coupled to the base portion 42. The tube portion 44 may be sized and shaped to retain the ends of the frame element 22*a* (e.g., with either male or female mating connections).

Figure 6:
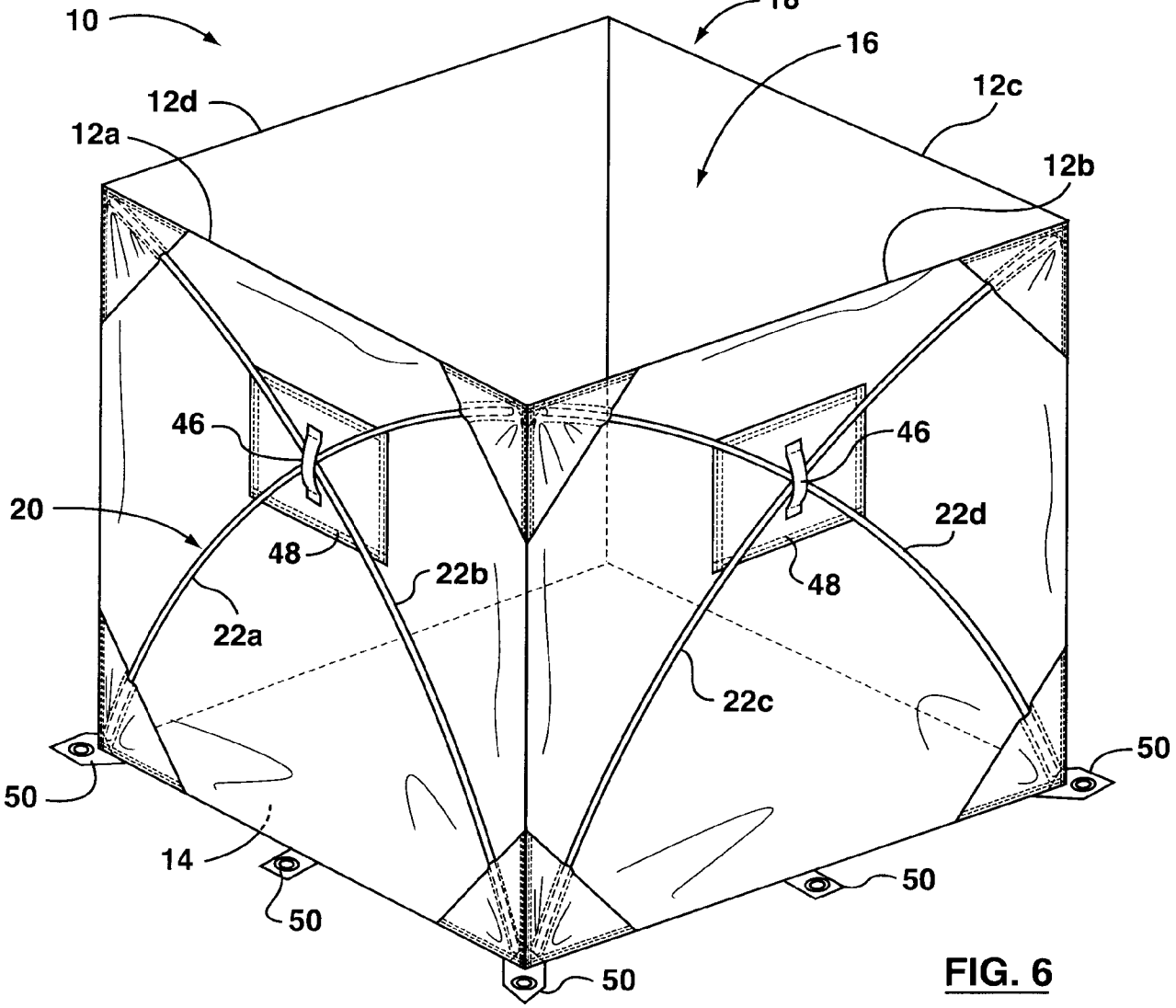
FIGS. 6, 7, 8, 9 and 10 are perspective views of flexible bulk containers and support structures according other examples.

Referring to FIG. 6, the side walls 12*a*, 12*b* are shown each including a central loop 46. The central loops 46 may be used to couple the frame elements 22*a*, 22*b* and 22*c*, 22*d* together. The central loops 46 may be unfixed to the side walls 12*a* and 12*b*, or, as in the example illustrated, the central loops 46 may be mounted to the to the side walls 12*a* and 12*b* by way of a central patch, generally at a point where the frame elements 22*a*, 22*b* and 22*c*, 22*d* diagonally overlap. The central loops 46 may generally restrict movement of the side walls 12*a*, 12*b* into the interior space 16, and restrict movement of the frame elements 22*a*, 22*b* and 22*c*, 22*d* relative to one another and the side walls 12*a*, 12*b*.

Furthermore, as shown in FIG. 6 the flexible bulk container 10 may include peg flaps 50 coupled to the side walls 12*a*, 12*b* and/or the bottom wall 14 for anchoring the flexible bulk container 10 to the ground.

Figure 7:
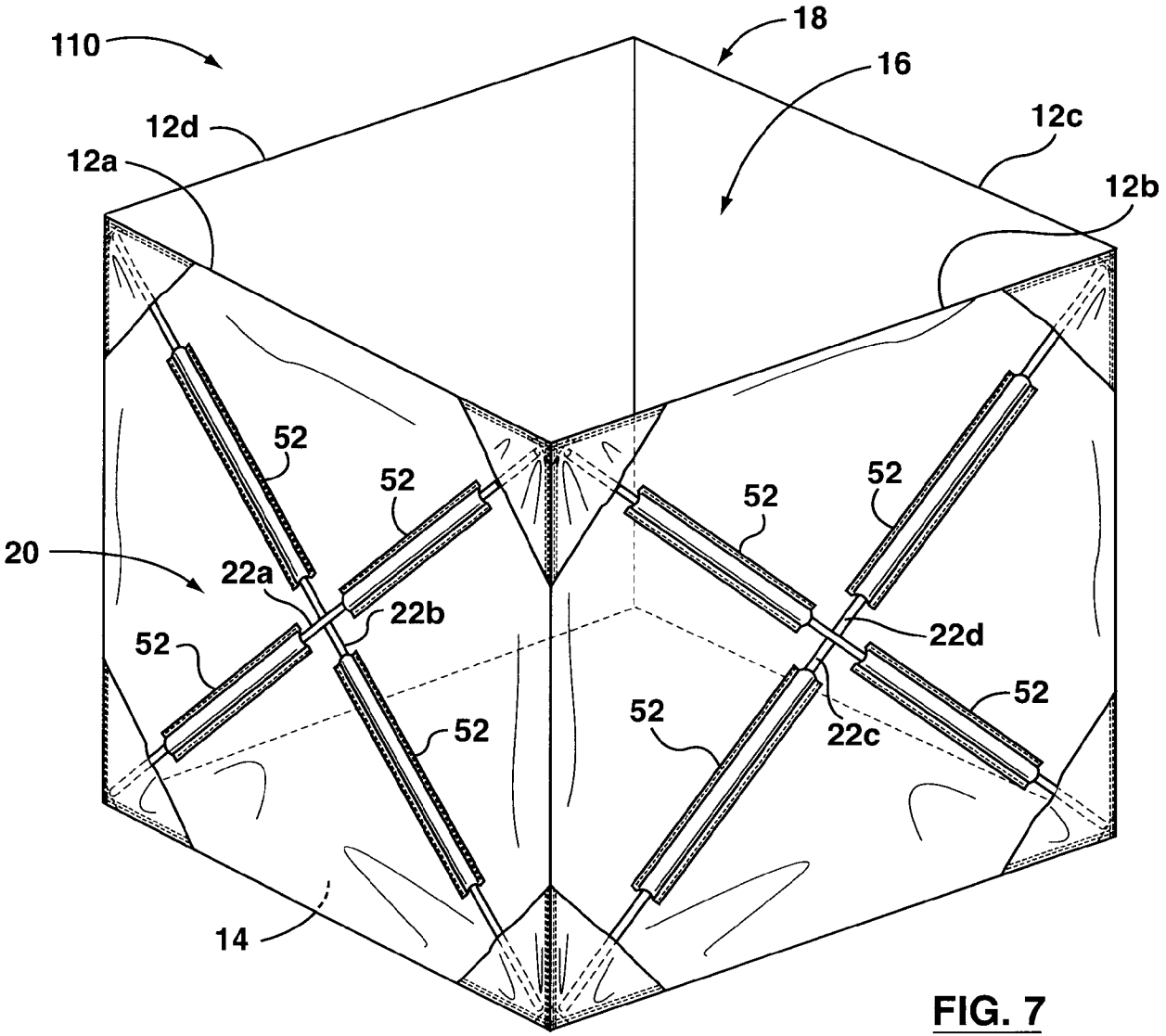

Referring to FIG. 7, a flexible bulk container 110 includes elongate sleeves 52 for coupling frame elements 22*a*, 22*b* and 22*c*, 22*d* to the side walls 12*a* and 12*b*, respectively. The sleeves 52 may be formed by stitching a patch of fabric onto the side walls 12*a*, 12*b*. The sleeves 52 may be used to generally restrict movement of the side walls 12*a*, 12*b* into the interior space 16, and restrict movement of the frame elements 22*a*, 22*b* and 22*c*, 22*d* relative to the side walls 12*a*, 12*b*.

Figure 8:
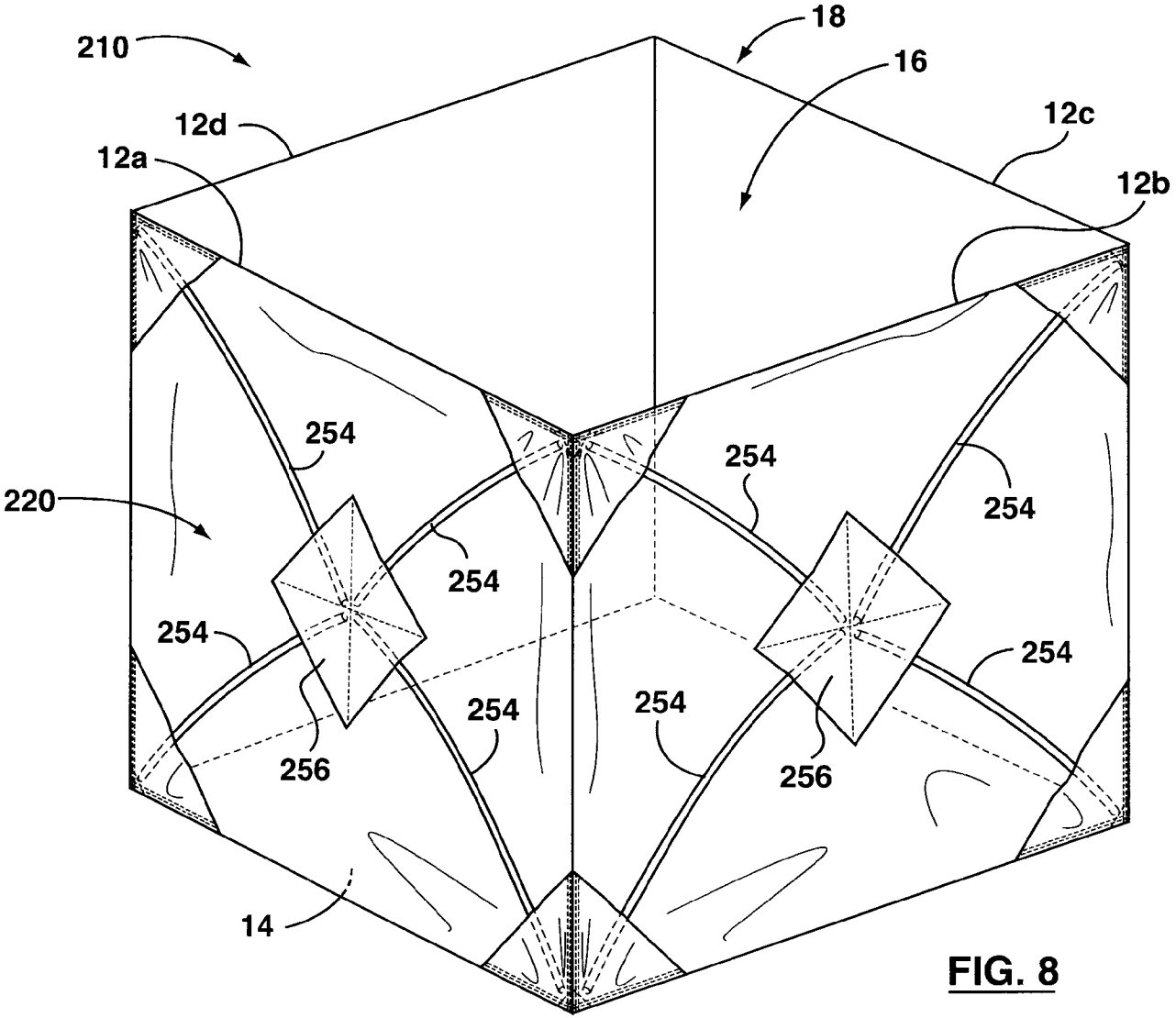

Referring to FIG. 8, a support structure 220 is attached to a flexible bulk container 210. The support structure 220 includes elongate half segment frame elements 254. It may be appreciated that half segment frame elements 254 may reduce the size of the unassembled support structure as compared to the frame elements 22 described above. The half segment frame elements 254 are attached to the side walls 12*a*, 12*b*, with two of the half segment frame elements 254 extending diagonally in series between opposite corners of the side walls 12*a*, 12*b*. The side walls 12*a*, 12*b* may include central patches 256 configured to retain inward ends of the half segment frame elements 254 so that each of the half segment frame elements 254 extend diagonally from the central patch 256 to a different corner of the side walls 12*a*, 12*b*. The central patches 256 may each define four pockets sized and shaped to retain ends of half segment frame elements 254. The central patches 256 may be stitched to form the pockets which may be suitably dimensioned so that they restrict movement of the half segment frame elements 254.

Figure 9:
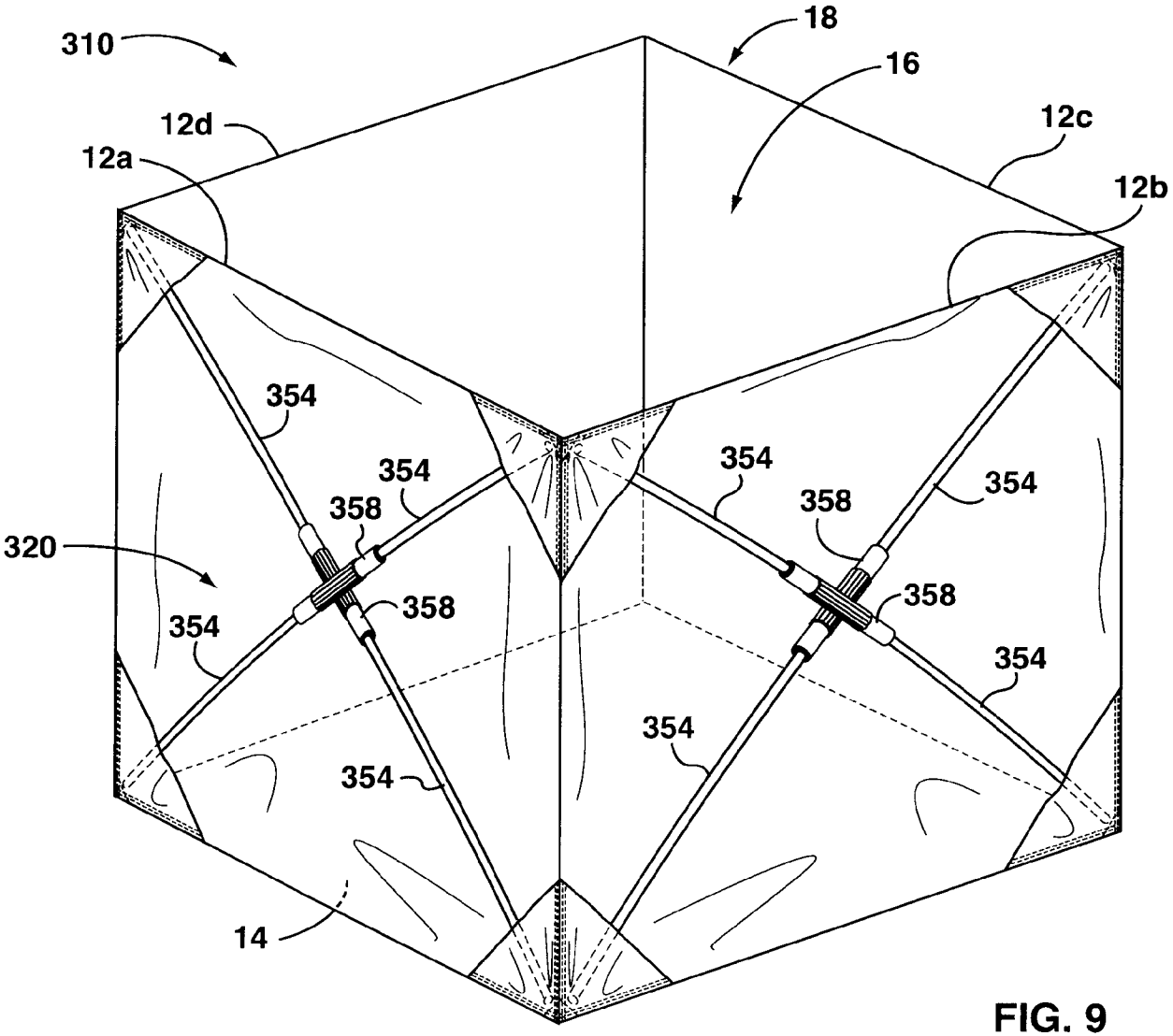

Referring to FIG. 9, a support structure 320 is attached to a flexible bulk container 310. The support structure 320 includes elongate half segment frame elements 354. Frame connectors 358 are configured to connect two of the half segment frame elements 354 in series and diagonally between opposite corners of the side walls 12*a*, 12*b*. Each of the frame connectors 358 may include a suitable male or female mating connection, and may include ribs or other gripping features so that it may be handled as a leverage point to resiliently flex the two of the half segment frame elements 354 to enable ends of the two of the half segment frame elements 354 to be inserted into pockets provided at the opposite corners of the side walls 12*a*, 12*b*.

Figure 10:
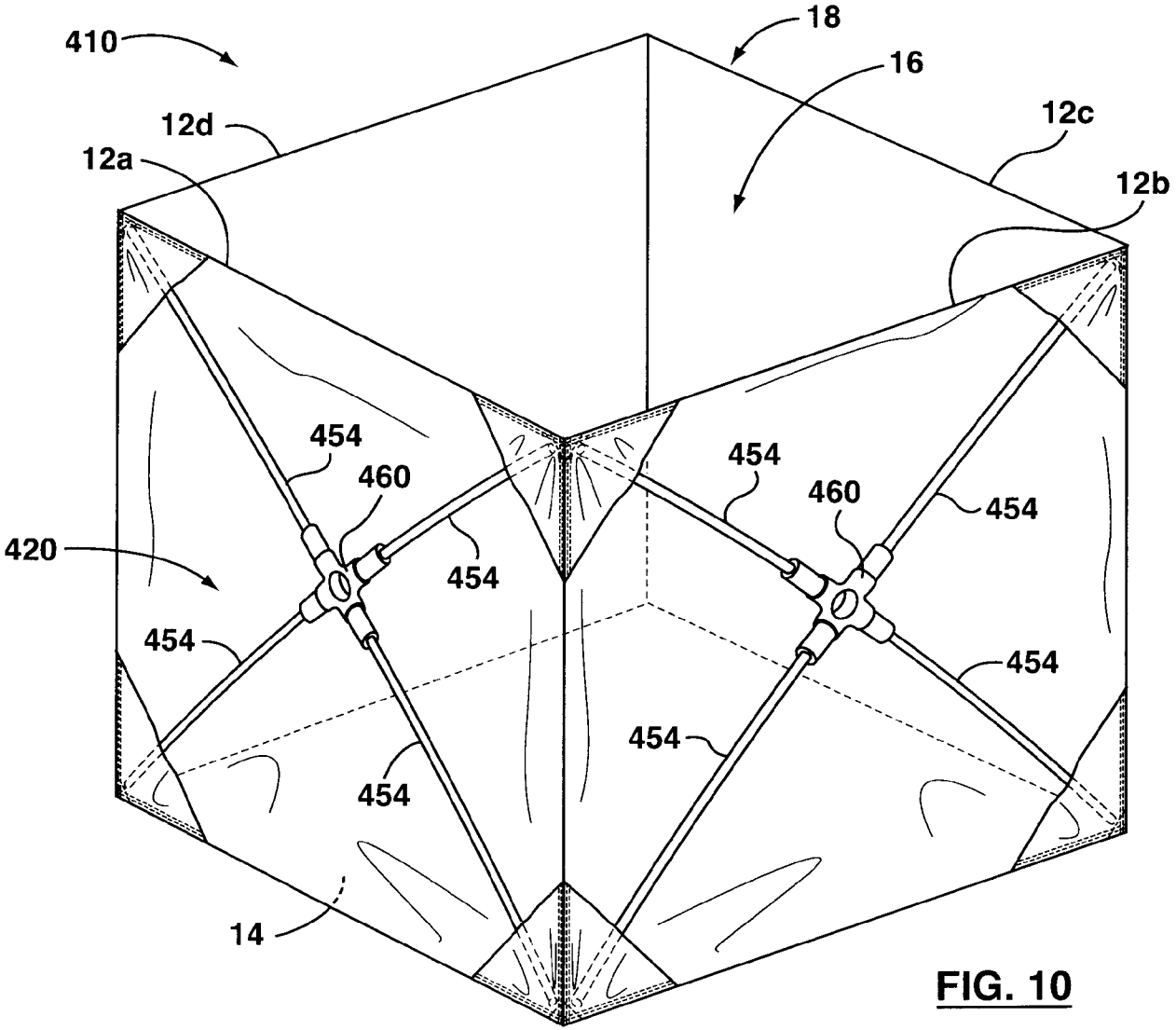

Referring to FIG. 10, a support structure 420 is attached to a flexible bulk container 410. The support structure 420 includes elongate half segment frame elements 454. A central connector hub 460 is configured to connect to inward ends of the four of the half segment frame elements 454, with each of the half segment frame elements 454 extending diagonally between the central connector hub 460 and a different corner of the side walls 12*a*, 12*b*. The central connector hub 460 may include a suitable male or female mating connection. In various examples, the central connector hub 460 may be unconnected to the side walls 12*a*, 12*b*, rigidly fixed to the side walls 12*a*, 12*b*, or loosely attached to the side walls 12*a*, 12*b* with an elastic connection (not shown).

Figure 11:
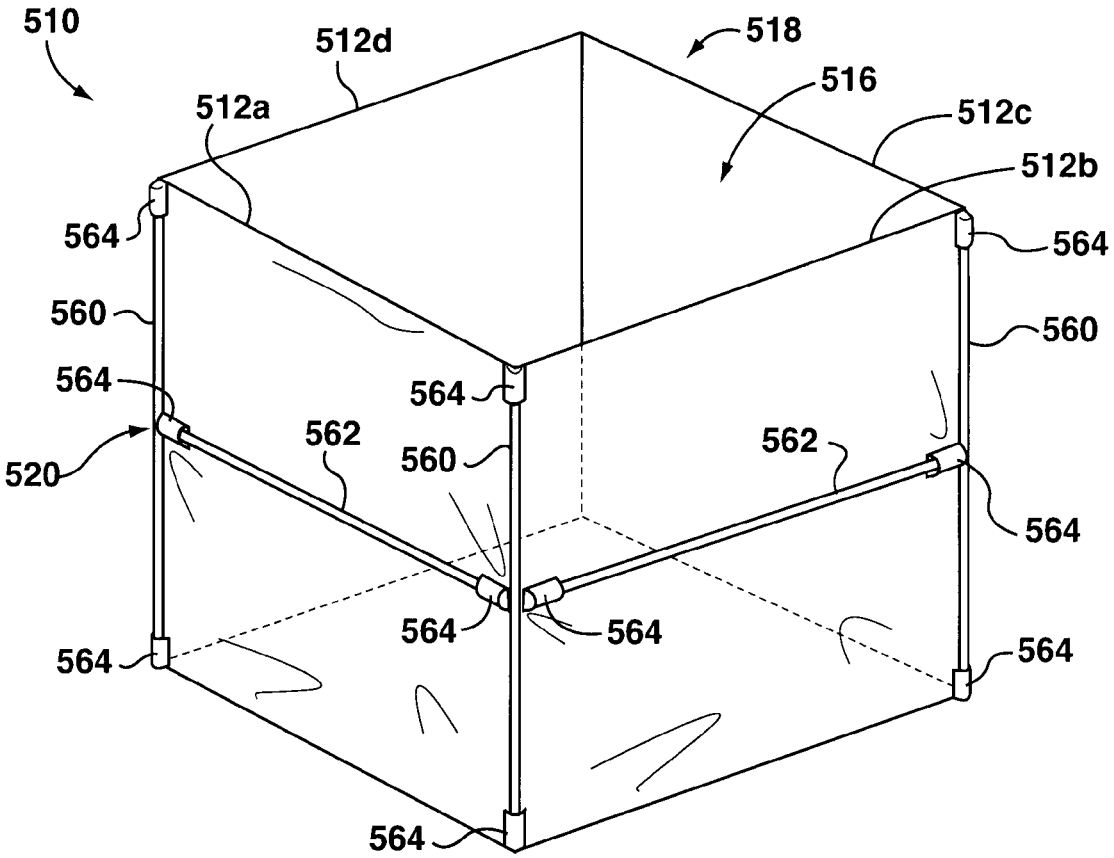
FIG. 11 is a perspective view of a flexible bulk container and a support structure therefor, according to another example.
Figure 11A:
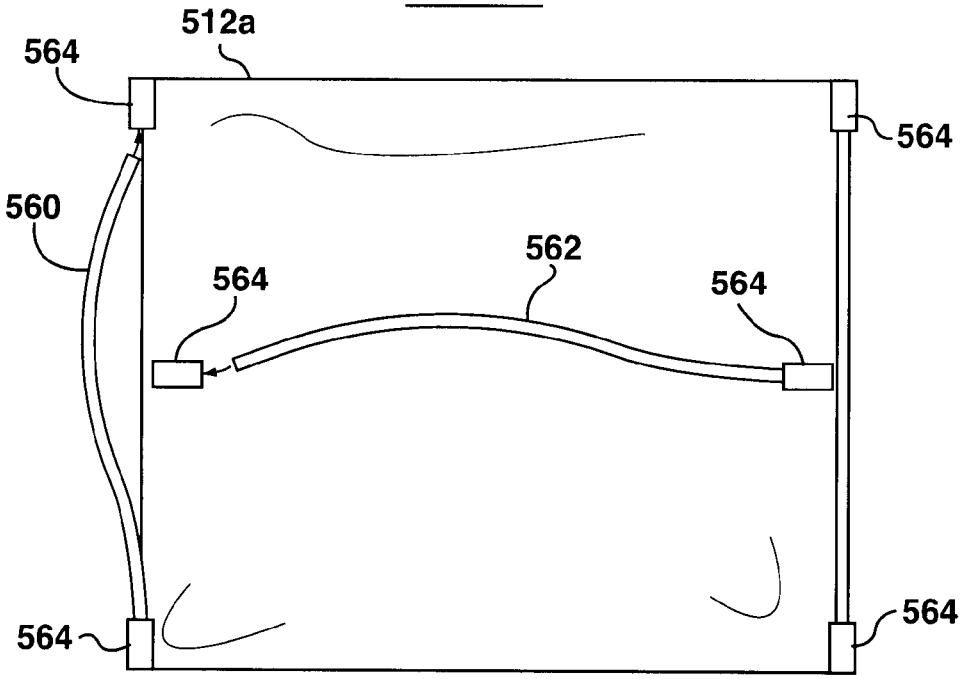
FIG. 11A is a view of a side wall of the flexible bulk container and the support structure of FIG. 11.

Referring to FIGS. 11 and 11A, a support structure 520 is attached to a flexible bulk container 510. The support structure 520 includes elongate first frame elements 560 that extend generally vertically. In the example illustrated, the first frame elements 560 are arranged generally at the corners of the flexible bulk container 510. The support structure 520 further includes elongate second frame elements 562 that extend generally horizontally. In the example illustrated, the second frame elements 562 are arranged generally across a middle of the flexible bulk container 510. The flexible bulk container 510 includes a plurality of pockets 564 for retaining ends of the frame elements 560, 562.

Referring particularly to FIG. 11A, when attaching the frame elements 560, 562 to the side wall 512*a*, the frame elements 560, 562 may be resiliently flexed to enable ends of the frame elements to be inserted into the pockets 564.

Figure 12:
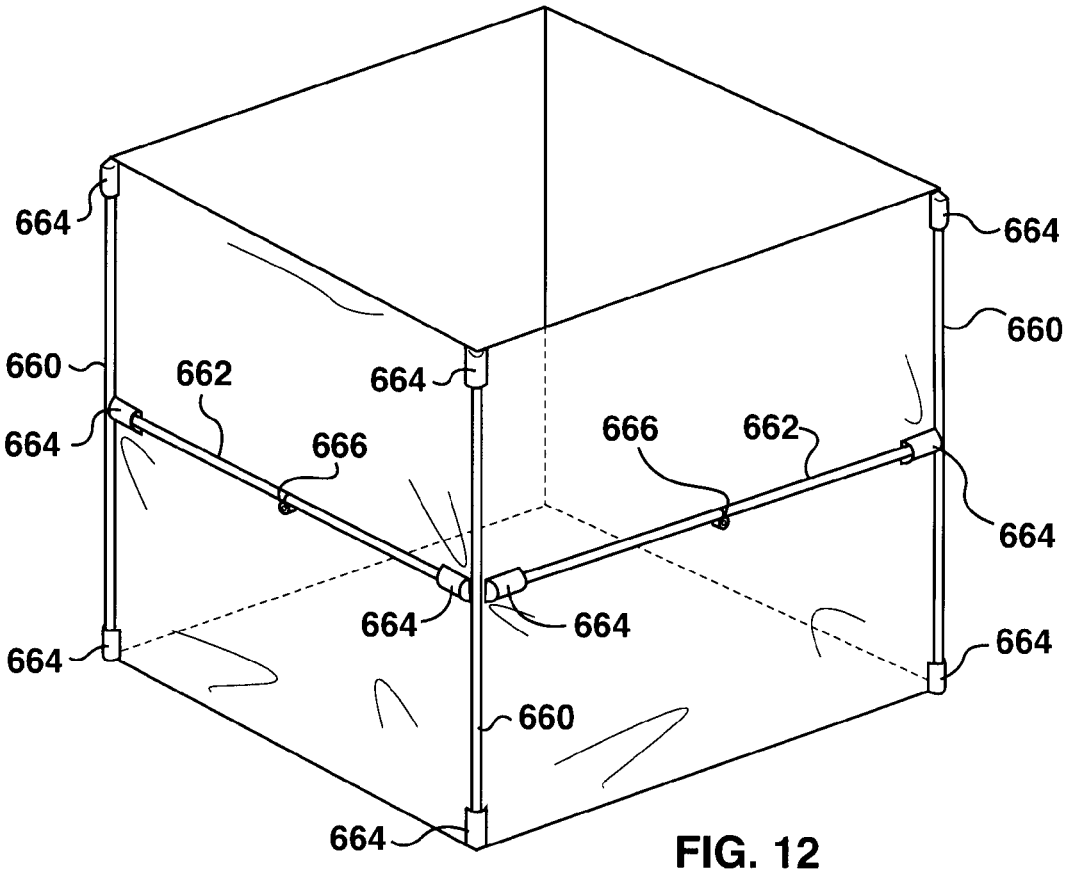
FIG. 12 is a perspective view of a flexible bulk container and a support structure therefor, according to another example.
Figure 12A:
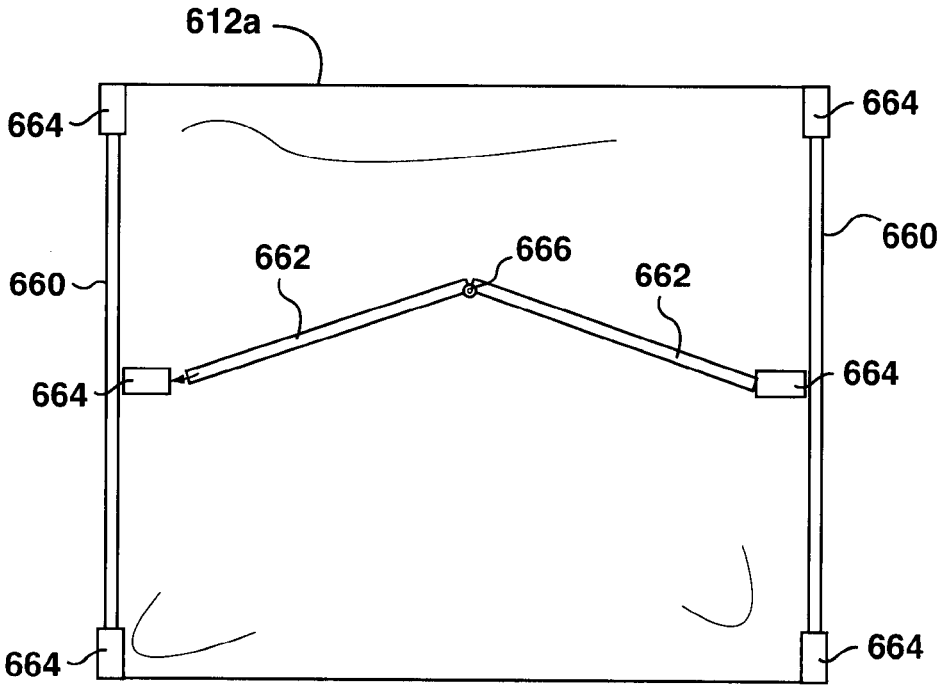
FIG. 12A is a view of a side wall of the flexible bulk container and the support structure of FIG. 12.

FIGS. 12 and 12A show an alternative configuration in which frame elements 662 may be generally rigid half segments connected by a hinge 666. Referring particularly to FIG. 12A, when attaching the frame elements 662 to the side wall 612*a*, the hinge 666 may allow the frame elements 662 to be pivoted relative to one another to enable ends to be inserted into the pockets 664. In some examples, the hinge 666 may be configured for over-center locking, or another suitable locking mechanism may be implemented to lock the hinge 666 in place to keep the frame elements 662 generally parallel.

Figure 13:
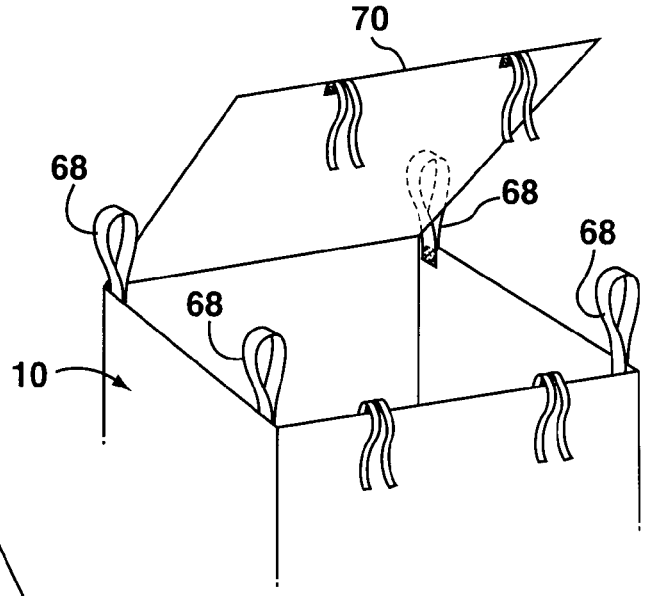
FIGS. 13, 13A and 13B are upper partial perspective views of flexible bulk containers.
Figure 13A:
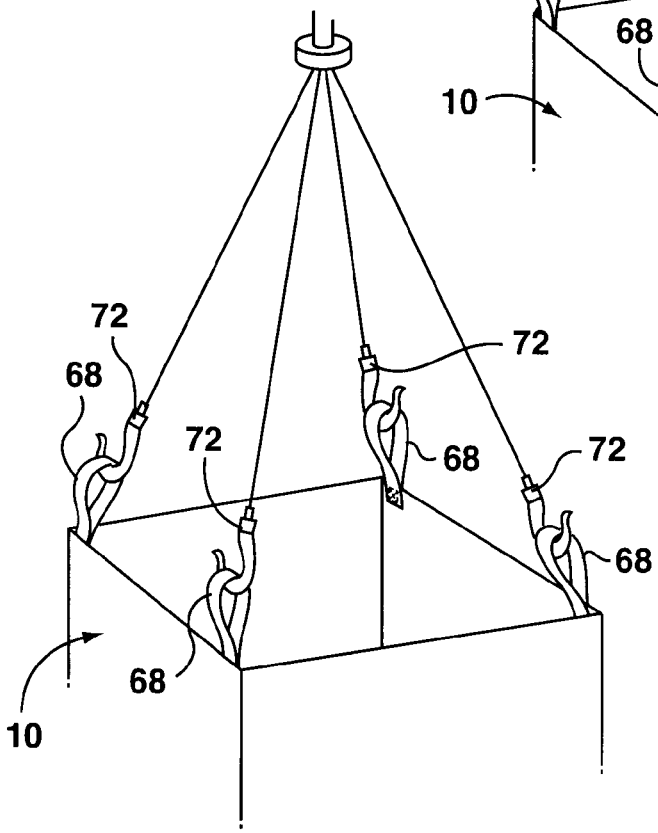
Figure 13B:
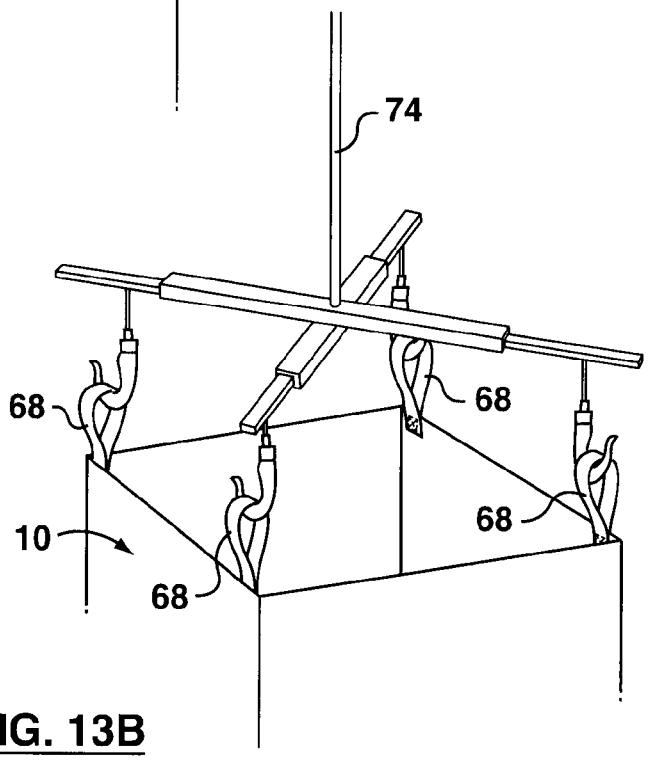

In various examples, and referring to FIGS. 13, 13A and 13B, the flexible bulk container 10 may include a lid wall 70 coupled to at least one of the side walls to cover the interior space of the flexible bulk container 10. Ties or other means may be used to secure the lid wall 70 closed. Furthermore, the flexible bulk container 10 may include a "full open" bottom wall, so that the materials loaded within the interior space can be dumped out of the bottom wall when the flexible bulk container 10 is lifted (i.e. and ties or a flap is cut to release the bottom wall).

The flexible bulk container 10 may include at least one loop 68 coupled to at least one of the side walls for lifting the flexible bulk container 10. Hooks 72 may be used to pick up the flexible bulk container 10 by the loops 68 to move it, load it onto a vehicle, etc.

Although not shown, in some examples lifting loops also may be provided along the bottom perimeter of the flexible bulk container 10 to assist with dumping the flexible bulk container 10 or securing it to the ground (e.g., four loops, with one arranged at each bottom corner).

Referring particularly to FIG. 13B, a device 74 may be used in conjunction with a crane (not shown) to pick up the flexible bulk container 10 to lift the flexible bulk container 10, to move it, load it onto a vehicle, etc. The device 74 includes arms, and hooks are slidably mounted to the arms so that the device 74 may be adjusted to account for different sizes of the flexible bulk container 10. The device 74 may ensure that the side walls of the flexible bulk container 10 are not pulled inwardly during lifting and therefore undue stress on the materials loaded into the flexible bulk container may be avoided. The arms of the device 74 may also be collapsible or foldable so that the device 74 is reduced in size for ease of transport.

Figure 14:
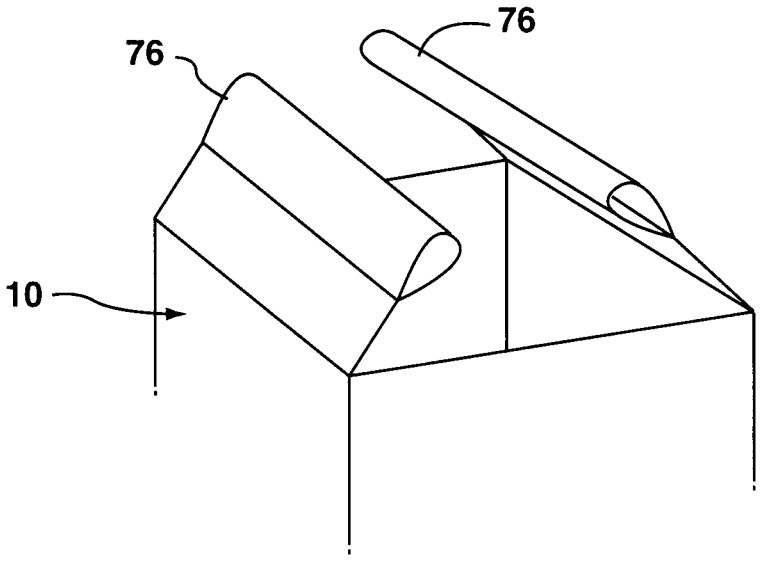
FIGS. 14 and 14A are upper and lower, respectively, partial perspective views of flexible bulk containers.
Figure 14A:
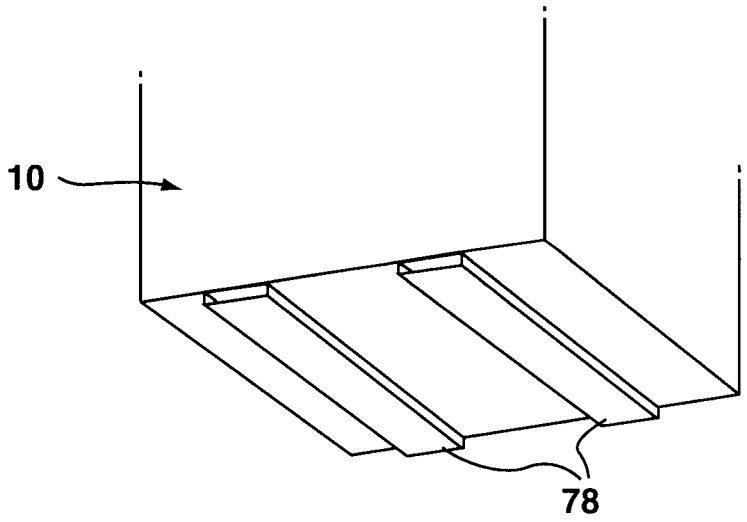

FIG. 14 shows sleeves 76 which may be used to receive tines of a fork lift truck (not shown) to lift the flexible bulk container 10, to move it, load it onto a vehicle, etc. The sleeves 76 may be arranged along top edges of side walls of the flexible bulk container 10. FIG. 14A shows sleeves 78 for receiving tines of a fork lift truck (not shown), with the sleeves 78 arranged along a bottom wall of the flexible bulk container 10.

Figure 15:
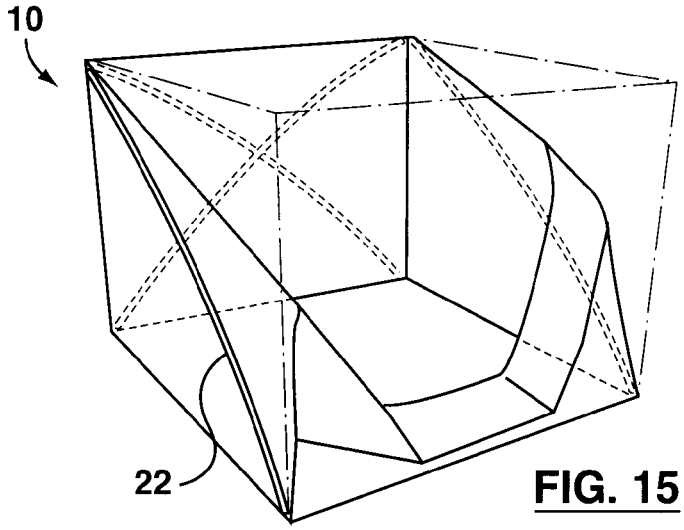
FIGS. 15 to 19 are schematic perspective views of flexible bulk containers and support structures, with a height of the flexible bulk container reduced.
Figure 16:
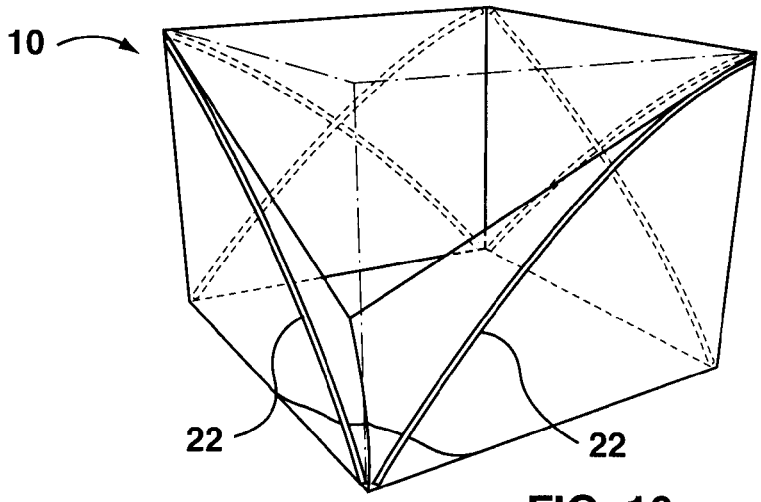
Figure 17:
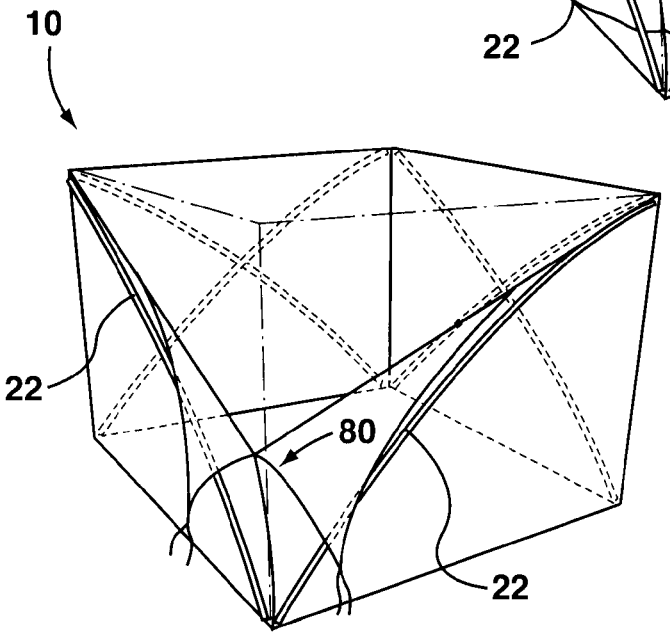
Figure 18:
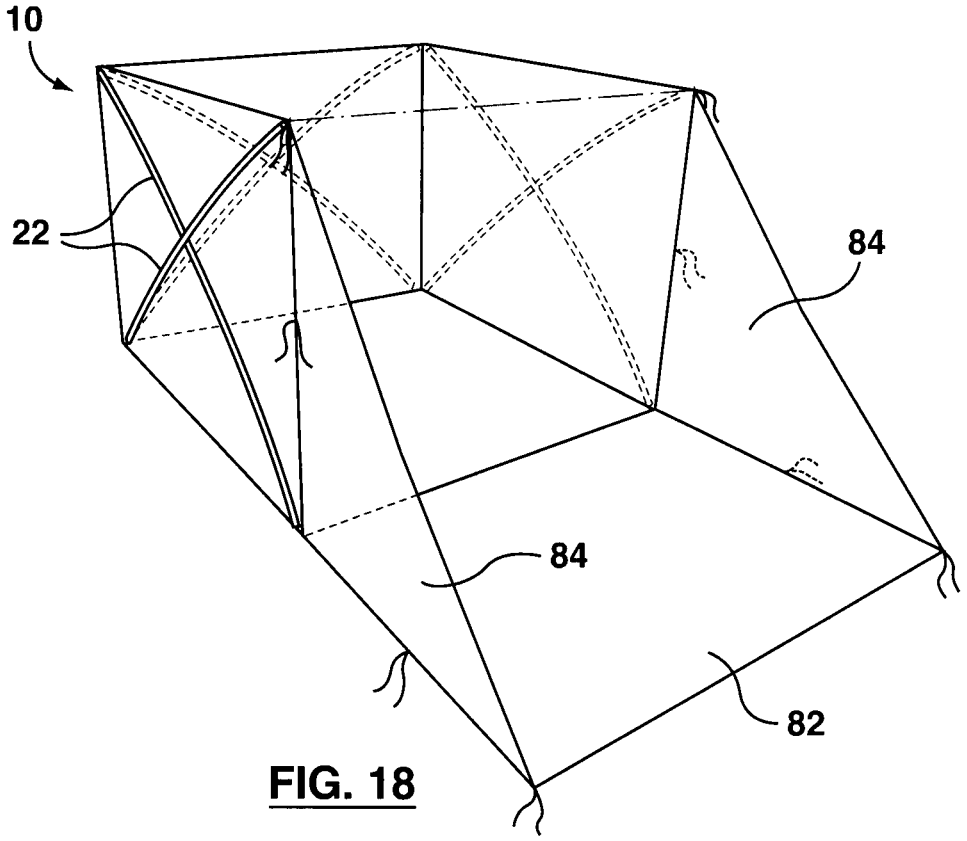
Figure 19:
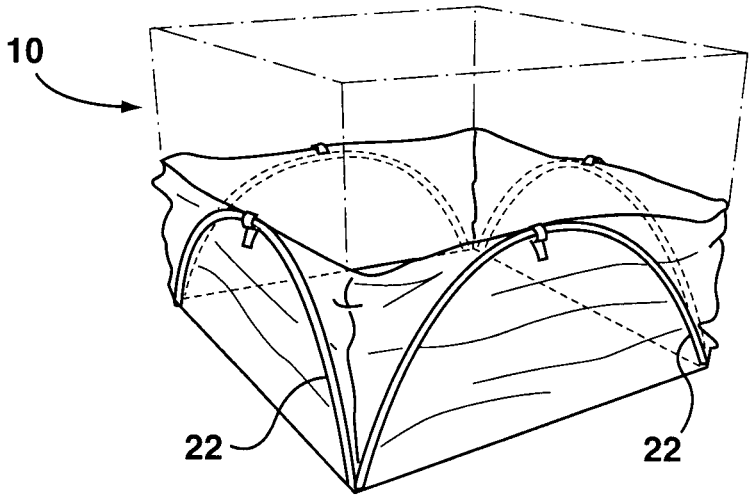

FIGS. 15 to 19 show various examples of manipulating a flexible bulk container 10 and a supporting structure including frame elements 22 so that a height of at least some portion of the sidewalls of the flexible bulk container 10 is reduced to facilitate easier loading. In particular, FIG. 15 shows that a front side wall has been folded down. Single frame elements 22 are shown attached to the left and right side walls. FIG. 16 shows that one upper corner of the flexible bulk container 10 has been folded down. Single frame elements 22 are shown attached to the side walls on either side of the upper corner that has been folded down. FIG. 17 is similar to FIG. 16, but there is provided a corner slit 80 between the side walls. FIG. 18 shows a drawbridge-style opening, in which the side wall 82 is folded down entirely, with panels 84 coupling the side wall 82 with the other side walls. FIG. 19 shows a flexible bulk container 10 that has been folded down around its entire perimeter. As shown, single frame elements 22 can be attached between the lower corners to reduce the height.

It may be appreciated that the various examples of flexible bulk containers and support structures described herein may be used in a waste management system for the loading and sorting of bulk waste materials, such as construction debris, rubbish, industrial waste and the like, which deals with materials for the purposes of recycling and/or disposal. The teachings herein may enable a simple, cost effective, portable and generally easy to use waste management system, which consists of relatively few components and a set up procedure that places relatively modest physical demands upon a user. No specialized tools required may be required, and the system may allow for the ability for components to be readily replaced after long use or loss.

For example, at a given site where bulk waste materials are being generated, a supply of flexible bulk containers may be provided at a staging area. A support structure may be attached to a first flexible bulk container so that the first flexible bulk container is maintained in a generally open position. Bulk waste materials may then be loaded into the interior space of the first flexible bulk container. Either during loading of the first flexible bulk container or after it is fully loaded, the support structure may be detached from the first flexible bulk container and attached to a second flexible bulk container so that the second flexible bulk container is maintained in a generally open position. Bulk waste materials may then be loaded into the interior space of the second flexible bulk container. This cycle may be repeated continuously; the flexible bulk containers which are fully loaded may then be picked up from the staging area, and transported away for disposal or other processing.

The flexible bulk containers and support structures may be relatively light and compact, and the sorting of materials may be completed at its origin, and thus a decrease in carbon footprint may result as compared to waste management systems which utilize roll-off dumpster containers.

Multiple flexible bulk containers may be set up and loaded at the waste origin, enabling the sorting of materials to be carried out at the time of disposal. Different color flexible bulk containers may allow for identification of recyclables versus mixed waste material. The flexible bulk containers and support structures may be distributed through a retail network. For example, one or more of the flexible bulk containers and a support structure may be sold or rented as a kit of parts.

While the above description provides examples of one or more processes or apparatuses, it will be appreciated that other processes or apparatuses may be within the scope of the accompanying claims.

We claim:

1. In combination:

a flexible bulk container comprising a plurality of side walls coupled to a bottom wall, the side walls and the bottom wall enclosing an interior space that is accessible through a top of the flexible bulk container; and a support structure comprising a plurality of frame elements, each of the frame elements being elongate, flexible and resilient, each of the frame elements attached to a respective one of the side walls and configured to support the respective one of the side walls upright so that the flexible bulk container is maintained in an open position, each of the frame elements being detachable from the respective one of the side walls, wherein the frame elements are arranged externally from the interior space of the flexible bulk container, wherein each of the frame elements is coupled to an outer surface of the respective one of the side walls, wherein each of the frame elements is detachable from the respective one of the side walls independently of the others of the frame elements, wherein there are two of the frame elements per each of the side walls, and wherein, for each of the side walls:

a first one of the frame elements extends diagonally between a first lower corner of the side wall and a first upper corner of the side wall opposite from the first lower corner;

a longitudinal dimension of the first one of the frame elements is greater than a first diagonal dimension between the first lower and upper corners, so that the first one of the frame elements is in a flexed condition and biases the first lower and upper corners away from one another;

a second one of the frame elements extends diagonally between a second lower corner of the side wall and a second upper corner of the side wall opposite from the second lower corner;

a longitudinal dimension of the second one of the frame elements is greater than a second diagonal dimension between the second lower and upper corners, so that the second one of the frame elements is in a flexed condition and biases the second lower and upper corners away from one another;

the first one and the second one of the frame elements diagonally overlap one another at a central position of the side wall; and a first vertical dimension between a top edge of the side wall and the central position is substantially less than a second vertical dimension between the central position and a bottom edge of the side wall.

2. The combination of claim 1, wherein, for each of the side walls, the corners comprise corner patches configured to retain respective ends of the first and second ones of the frame elements.

3. The combination of claim 2, wherein the corner patches comprise pockets sized and shaped to retain the respective ends of the first and second ones of the frame elements.

4. The combination of claim 3, wherein the corner patches are stitched to form the pockets.

5. The combination of claim 2, wherein the ends of the first and second ones of the frame elements comprise clips configured to grip the respective corner patch.

6. The combination of claim 1, wherein the corners of each of the side walls comprise corner connectors, the corner connectors comprising a base portion mounted to the at least one of the side walls and a tube portion coupled to the base portion, the tube portion sized and shaped to retain ends of the first and second ones of the frame elements.

7. The combination of claim 1, further comprising, for each of the side walls, a central loop coupling the first and second ones of the frame elements together where the first and second ones of the frame elements diagonally overlap.

8. The combination of claim 7, wherein, for each of the side walls, the central loop is fixed to the side wall, and restricts movement of the first and second ones of the frame elements relative to one another and the side wall.

9. The combination of claim 1, wherein the flexible bulk container further comprises at least one loop coupled to at least one of the side walls for lifting the flexible bulk container.

10. The combination of claim 1, wherein the flexible bulk container further comprises a lid wall coupled to at least one of the side walls to cover the interior space at the top of the flexible bulk container.

11. The combination of claim 1, wherein the flexible bulk container further comprises a plurality of peg flaps coupled to at least one of the side walls and the bottom wall for anchoring the flexible bulk container to the ground.

12. The combination of claim 1, wherein, for each of the side walls, the first one of the frame elements defines a first arc axis between the first lower corner and the first upper corner, and the second one of the frame elements defines a second arc axis between the second lower corner and the second upper corner.

13. The combination of claim 12, wherein, for each of the side walls:

the first arc axis forms a first top angle with the top edge at the first upper corner and a first bottom angle with the bottom edge at the first lower corner, and the first top angle is substantially smaller than the first bottom angle; and the second arc axis forms a second top angle with the top edge at the second upper corner and a second bottom angle with the bottom edge at the second lower corner, and the second top angle is substantially smaller than the second bottom angle.

14. A kit of parts, comprising:

a) a flexible bulk container comprising i) a bottom wall, ii) a plurality of rectangular side walls coupled to the bottom wall, the side walls and the bottom wall enclosing an interior space that is accessible through a top of the flexible bulk container, each of the side walls comprising an outer surface, a bottom edge that is coupled to the bottom wall, a first side edge that is coupled to a first adjacent side wall, a second side edge that is coupled to a second adjacent side wall, and a top edge, and iii) a plurality of pockets formed on the outer surface of each of the side walls, with a first and a second pocket disposed at diagonally opposite first lower and upper corners, respectively, of each of the side walls, and a third and a fourth pocket disposed at diagonally opposite second lower and upper corners, respectively, of each of the side walls; and b) a plurality of frame elements, each of the frame elements being elongate, flexible and resilient, each of the frame elements attachable to a respective one of the side walls by inserting opposite ends of the frame element into one of the first and second pockets or the third and fourth pockets so that, for each of the side walls, a first one of the frame elements extends diagonally between the first lower and upper corners, and a second one of the frame elements extends diagonally between the second lower and upper corners, wherein a longitudinal dimension of each of the frame elements is greater than a diagonal dimension between the first and second pockets or the third and fourth pockets so that each of the frame elements is retained in a flexed condition between the first and second pockets or the third and fourth pockets and biases the lower corners away from the upper corners so that the side wall is in tension, wherein, for each of the side walls, the first one and the second one of the frame elements diagonally overlap one another at a central position of the side wall, and a first vertical dimension between the top edge of the side wall and the central position is substantially less than a second vertical dimension between the central position and the bottom edge of the side wall, and whereby the plurality of frame elements are attachable to form a support structure that maintains the flexible bulk container in an open position.

15. The kit of parts of claim 14, further comprising, for each of the side walls, a central loop coupling the first and second ones of the frame elements together where the first and second ones of the frame elements diagonally overlap.

16. The kit of parts of claim 15, wherein, for each of the side walls, the central loop is fixed to the side wall, and restricts movement of the first and second ones of the frame elements relative to one another and the side wall.

17. The kit of parts of claim 14, wherein the flexible bulk container further comprises at least one loop coupled to at least one of the side walls for lifting the flexible bulk container.

18. The kit of parts of claim 14, wherein the flexible bulk container further comprises a lid wall coupled to at least one of the side walls to cover the interior space at the top of the flexible bulk container.

19. The kit of parts of claim 14, wherein the flexible bulk container further comprises a plurality of peg flaps coupled to at least one of the side walls and the bottom wall for anchoring the flexible bulk container to the ground.

20. The kit of parts of claim 14, wherein each of the plurality of pockets is formed by a respective corner patch stitched to the respective side wall.

* * * * *